US005385091A

United States Patent [19]

Cuir et al.

[11] Patent Number: 5,385,091

[45] Date of Patent: Jan. 31, 1995

[54] SHEET-FED PRINT INSTALLATION AND A CORRESPONDING PRINT LINE

[76] Inventors: Jean-Pierre Cuir, 36 avenue de Brigode; Gérard Cuir, 23 allée des Grands Champs, both of 59650 Villeneuve D'Ascq, France

[21] Appl. No.: 217,308

[22] Filed: Mar. 23, 1994

[30] Foreign Application Priority Data

Mar. 26, 1993 [FR] France ..... 93 03707

[51] Int. Cl.[6] ..... B41F 7/02; B41F 13/24

[52] U.S. Cl. ..... 101/217; 101/233; 101/248

[58] Field of Search ..... 101/217, 232, 233, 212, 101/248, 142, 177, 181; 271/258, 259

[56] References Cited

U.S. PATENT DOCUMENTS

| | | | |
|---|---|---|---|
| 4,428,288 | 1/1984 | Harper et al. | 101/248 |
| 4,458,893 | 7/1984 | Ruh | 271/277 |
| 4,552,066 | 11/1985 | Giori et al. | 101/248 |
| 4,553,478 | 11/1985 | Greiner et al. | 101/181 |
| 5,233,920 | 8/1993 | Shinmoto et al. | 101/181 |
| 5,309,834 | 5/1994 | Koch | 101/248 |
| 5,313,886 | 5/1994 | Müller | 101/248 |

FOREIGN PATENT DOCUMENTS

| | | |
|---|---|---|
| 0051037 | 5/1982 | European Pat. Off. . |
| 4031964 | 4/1992 | Germany . |

*Primary Examiner*—Eugene H. Eickholt
*Attorney, Agent, or Firm*—Ladas & Parry

[57] ABSTRACT

The sheet feed print installation of the flexographic type for printing on a semi-rigid material of the corrugated card type comprises:

a plate-carrier cylinder having a plate of thickness $E_c$ fixed to the periphery thereof;

a backing system, optionally constituted by a backing cylinder;

a screened cylinder; and a transfer system having an inlet into which the sheets are inserted one by one.

The installation further comprises:

a) three or four motors which are mechanically independent, the first rotating the plate-carrier cylinder, the second rotating the screened cylinder, the third rotating the transfer system, and optionally the fourth rotating the backing cylinder; and b) an electronic circuit connected to the second, third, and optionally fourth motors, that receives an input reference signal and that includes means for inputting operating parameters, including at least the thickness $E_c$ of the plates and the print rate. The electronic circuit is programmed to control the rotation of said motors automatically as a function of the thickness $E_c$ and of the print rate so as to obtain optimum printing.

11 Claims, 2 Drawing Sheets

SHEET-FED PRINT INSTALLATION AND A CORRESPONDING PRINT LINE

FIELD OF THE INVENTION

The present invention relates to a flexographic type sheet-fed print installation for printing on a semi-rigid material such as corrugated card, the installation comprising a screened cylinder, a plate-carrier cylinder, a backing system, and a transfer system which feeds the sheets one by one between the plate-carrier cylinder and the backing cylinder. The invention relates more particularly to an installation of the above type which is suitable for working with plates of different thicknesses. Sheet-fed print installations of the invention are designed to be used in line in order to perform multiple sheet-fed printing.

BACKGROUND OF THE INVENTION

In such installations, in order to obtain high quality printing, it is necessary for the linear speed of the transfer system to be equal to the linear speed of the plate that is mounted on the plate-carrier cylinder so as to obtain contact without slip between the sheet and the plate during printing. The same applies to the peripheral linear speed of the backing system when constituted by a backing cylinder. In addition, in order to ensure uniform inking of the plate on each rotation of the plate-carrying cylinder, it is also necessary for the peripheral linear speed of the screened cylinder to be equal to the linear speed of the plate. In presently known installations, the various components mentioned above are coupled together mechanically and they are driven by a single motor. Consequently, the above-specified requirement for equal speeds is achieved for one given thickness of plate only. In practice, such installations are delivered by manufacturers with all of their components designed and organized to operate with a specific type of plate having a given thickness. Plate-carrier cylinders are machined as a function of the plate thickness specified by the printer so as to have a diameter, as measured on the plate, which is constant for a given type of machine.

Unfortunately, printers sometimes need to install on their installations plates of thicknesses other than that specified initially. Under such circumstances, print quality is degraded. When the thickness of the plate differs excessively from the thickness for which the installation was designed, the printer is constrained to work with a different installation designed to operate with the chosen plate thickness.

There also exist rotary presses for flexographic printing on a strip of continuous material, such presses including, in particular, a plate-carrier cylinder and a main cylinder round which the strip of material that is to be printed passes, said main cylinder enabling the material to be advanced and also acting as a backing cylinder. A rotary press of that particular type is already known, in particular from document FR 2 553 032, enabling the thickness of the plate used to be taken into account. That rotary press is fitted with at least two motors that are mechanically independent of each other, the first enabling the main cylinder to be rotated and the second enabling the plate carrier cylinder to be rotated. The position of the plate-carrier cylinder motor is servo-controlled relative to the main cylinder which is used as a reference, in such a manner that during the time in which the plate is in contact with the strip of material, the speed of rotation of the plate-carrier cylinder is such that the linear speed of the plate is equal to the peripheral linear speed of the main cylinder. On such machines, the developed size of the plate-carrier determines the printing pitch. The pitch can be varied a little. To do this, it is necessary to vary the speed of rotation of the plate-carrier cylinder during the time interval that the plate is not in contact with the material. This change in the speed of rotation of the plate-carrier cylinder during each 360° revolution of the cylinder is possible only with plate-carrier cylinders of small inertia. In addition, the longer the plate mounted on the periphery of the plate-carrier cylinder, the greater the speed variation that needs to be imparted to the plate-carrier cylinder in order to conserve the distance between two printing patterns.

Unlike rotary presses of the kind described in document FR 2 553 032, sheet-fed printing machines have plate-carriers that are not interchangeable. Their dimensions are large and determine the maximum format of sheet that can be printed. They therefore have considerable inertia and the plates may cover nearly all of the developed surface of the plate-carrier cylinder.

OBJECT AND SUMMARY OF THE INVENTION

The object of the present applicant is to provide an improved sheet-fed print installation that mitigates the drawback observed in presently-known sheet-fed printing machines in that it enables automatic operation under optimal conditions using plates of various thicknesses, regardless of the inertia of the plate-carrying cylinder or the length of the plate used.

This object is perfectly achieved by the installation of the invention which comprises the following in conventional manner:

a plate-carrier cylinder having a plate of thickness $E_c$ fixed to the periphery thereof;

a backing system, optionally constituted by a backing cylinder;

a screened cylinder; and a transfer system having an inlet into which the sheets are inserted one by one and which bring each sheet in succession to the pinch line between the plate-carrier cylinder and the backing cylinder.

In a manner characteristic of the invention, the installation further comprises:

a) three or four motors which are mechanically independent, the first rotating the plate-carrier cylinder, the second rotating the screened cylinder, the third rotating the transfer system, and optionally the fourth rotating the backing cylinder; and b) an electronic circuit connected to the second, third, and optionally fourth motors, that receives an input reference signal and that includes means for inputting operating parameters, including at least the thickness $E_c$ of the plates and the print rate. In this case, the first motor rotates the plate-carrier cylinder synchronously with the reference signal in such a manner that the plate-carrier cylinder rotates through 360° at constant speed during the time interval that corresponds to the print rate; the electronic circuit automatically controls rotation of the second, third, and optionally fourth motors on the basis of the reference signal and as a function of the thickness $E_c$ in such a manner firstly that the peripheral linear speed of the screened cylinder is equal to the linear speed of the plate on the plate-carrier cylinder, and secondly that the linear speed of the transfer system and optionally the peripheral linear speed of the backing cylinder are equal to the linear speed of the plate on the plate-carrier cylinder at least during the time interval $T_1$ during which the plate is printing.

The backing system may be constituted either by a stationary beam, or by a backing cylinder. When constituted by a backing cylinder, it is also possible for the same motor to drive both the transfer system and the backing cylinder.

The rate of printing corresponds to the time interval between two successive sheets being inserted into the inlet of the transfer system. The speed of rotation of the plate-carrier cylinder depends solely on said print rate which is input as an operating parameter into the electronic circuit, and which does not depend on the thickness or the length of the plate, unlike the plate-carrier cylinder of document FR 2 553 032. Consequently, when the plate is changed, the speed of the rotation of the plate-carrier cylinder is not modified and so the rate at which sheets are printed is not modified, and this applies in particular even when the plate-carrier cylinder is fitted with a plate of a different thickness. Thus, when the printer seeks to change a plate, and when the thickness of the plate that is to be fitted to the plate-carrier is different from the thickness of the previous plate, all that needs to be done is to input new data corresponding to the new thickness into the controlling electronic circuit via its input means. The rotation of the plate-carrier cylinder is not modified by this change. The speed of rotation of the screened cylinder will automatically be adjusted so that its peripheral linear speed is equal to the peripheral speed of the new plate. The speed of rotation of the third motor is automatically adjusted so that the sheet advance speed is equal to the linear speed of the plate, at least during the time interval during which the plate is in contact with the sheet.

In a first particular embodiment of the invention, the first motor rotates the plate-carrier cylinder at a predefined constant speed of rotation which fixes the print rate, and the plate-carrier cylinder is fitted with an encoder that delivers the reference signal to the electronic circuit, which reference signal is a function of the angular position of the plate-carrier cylinder.

In a second particular embodiment, the first motor is connected to the electronic control circuit which receives an input reference signal and which is suitable for controlling the rotation of the first motor synchronously with said signal and as a function of the print rate. In this case, the reference signal may be a purely electronic signal generated from a clock whose frequency can be modified. When the installation forms part of a print line, the reference signal may also be the reference signal delivered by an installation of the invention implemented in accordance with the first particular embodiment, or it may be obtained from another machine in line with the installation.

Preferably, in the second particular embodiment, the electronic circuit is suitable for controlling rotation of the first motor in such a manner as to bring the plate-carrier cylinder into an initial angular position that depends on a predefined setting parameter. This setting parameter makes it possible to define the position of the pattern printed on the sheet.

In theory, in order to ensure that the pattern is always printed in the proper position on the sheet, it would suffice for the linear speed of the transfer system to be exactly equal to the linear speed of the plate. In practice, as a sheet passes through the transfer system, it may slip a little, thereby becoming offset from the position that it ought theoretically to have, and thus causing the pattern to be printed in the wrong place on the sheet. It is also possible for the sheets to be of slightly different lengths, thus if the insertion system ensures that the leading edge of the sheet is synchronous with the installation and if it is desired that printing be in register with the trailing edge, then registration defects are observed. The same happens the other way around. In order to mitigate all the above drawbacks, regardless of the embodiment, the invention may further include in the transfer system at least one registration sensor connected to the electronic circuit and enabling the passage of an edge of a sheet to be detected. In this case, said electronic circuit is suitable, synchronously with the reference signal, for controlling the rotation of the third motor firstly during each time interval $T_1$ during which the plate is printing so that the linear speed of the transfer system is equal to the linear speed of the plate, and secondly during each time interval $T_2$ during which the plate is not printing so that the edge whose passage is detected at a determined distance from the pinch line reaches said pinch line when the plate-carrier cylinder is in a determined position. Regardless of whether it is the passage of the leading edge or of the trailing edge of a sheet that is detected, printing is set relative to the edge that is selected, i.e. the printing pattern is accurately positioned on the sheet.

Advantageously, the installation comprises two registration sensors disposed in the transfer system, one for detecting the leading edge, and the other for detecting the trailing edge of each sheet. In which case it also comprises means connected to the electronic circuit for selecting one or other of the sensors. Depending on whether the printer desires to position the printing pattern on the sheet relative to the leading edge or to the trailing edge thereof, the appropriate sensor is selected via the selection means.

Preferably, the installation is also fitted with apparatus for adjusting the axial distance of the screened cylinder relative to the plate-carrier cylinder, said apparatus being provided with a fifth individual motor connected to the electronic circuit. In this case the electronic circuit is suitable for controlling said fifth individual motor so as to bring the screened cylinder to a working position that depends on the thickness $E_c$ of the plate, and in which it bears against the surface of the plate.

When the installation includes both at least one registration sensor and the above-mentioned adjustment device, the electronic circuit is advantageously suitable for controlling the rotation of the fifth individual motor so as to cause the screened cylinder to move from its working position to a retracted position and vice versa each time the edge of a following sheet is not detected or is detected again, respectively, and to do so synchronously with the reference signal. This makes it possible to ink the plate only when a sheet is present for printing. In practise this position change is synchronized so as to take place while the screened cylinder overlies the zone of the plate-carrier that is not carrying a plate.

Advantageously, the installation of the invention is also fitted with apparatus for adjusting the distance between the backing system and the plate-carrier cylinder, said apparatus being provided with a sixth individual motor connected to the electronic circuit. In which case the electronic circuit is suitable for controlling rotation thereof in such a manner as to bring the backing system into a working position that depends on plate thickness $E_c$ and on the thickness of the sheets that are to be printed.

The invention also provides a print line for performing sheet-fed multiple printing comprising a plurality of installations of the invention whose plate-carrier cylinders are identical and are all fitted with plates having the same thickness $E_c$. In this case, all of the motors in each installation are connected to a single electronic circuit. Since all of the plate-carrier cylinders are identical, they are rotated at the same speed of rotation for a given print rate. Since the plates are also of the same thickness, they have identical linear speeds. When the print line also includes an upstream machine of the feeder type for inserting sheets to the inlet of the transfer system of the first installation in the print line, it is necessary for the rate of sheet insertion to coincide with the print rate, which is input as a parameter into the electronic circuit. It is also necessary for the upstream machine to insert sheets by imparting a linear speed thereto equal to the linear speed of the transfer system of said first installation. Consequently, the upstream machine is preferably also under the control of the electronic circuit.

More particularly, the print line of the invention may include an installation implemented in accordance with the first particular embodiment mentioned above. In which case the reference signal corresponds to the signal delivered by the encoder of the plate-carrier cylinder of said installation. The first motor of said installation then serves as a reference for synchronizing all of the motors in the other installations.

BRIEF DESCRIPTION OF THE DRAWINGS

Other characteristics and advantages of the invention appear from the following description of a particular embodiment of a flexographic print line of the invention, given with reference to the accompanying drawings, in which.

MORE DETAILED DESCRIPTION

Figure 1:
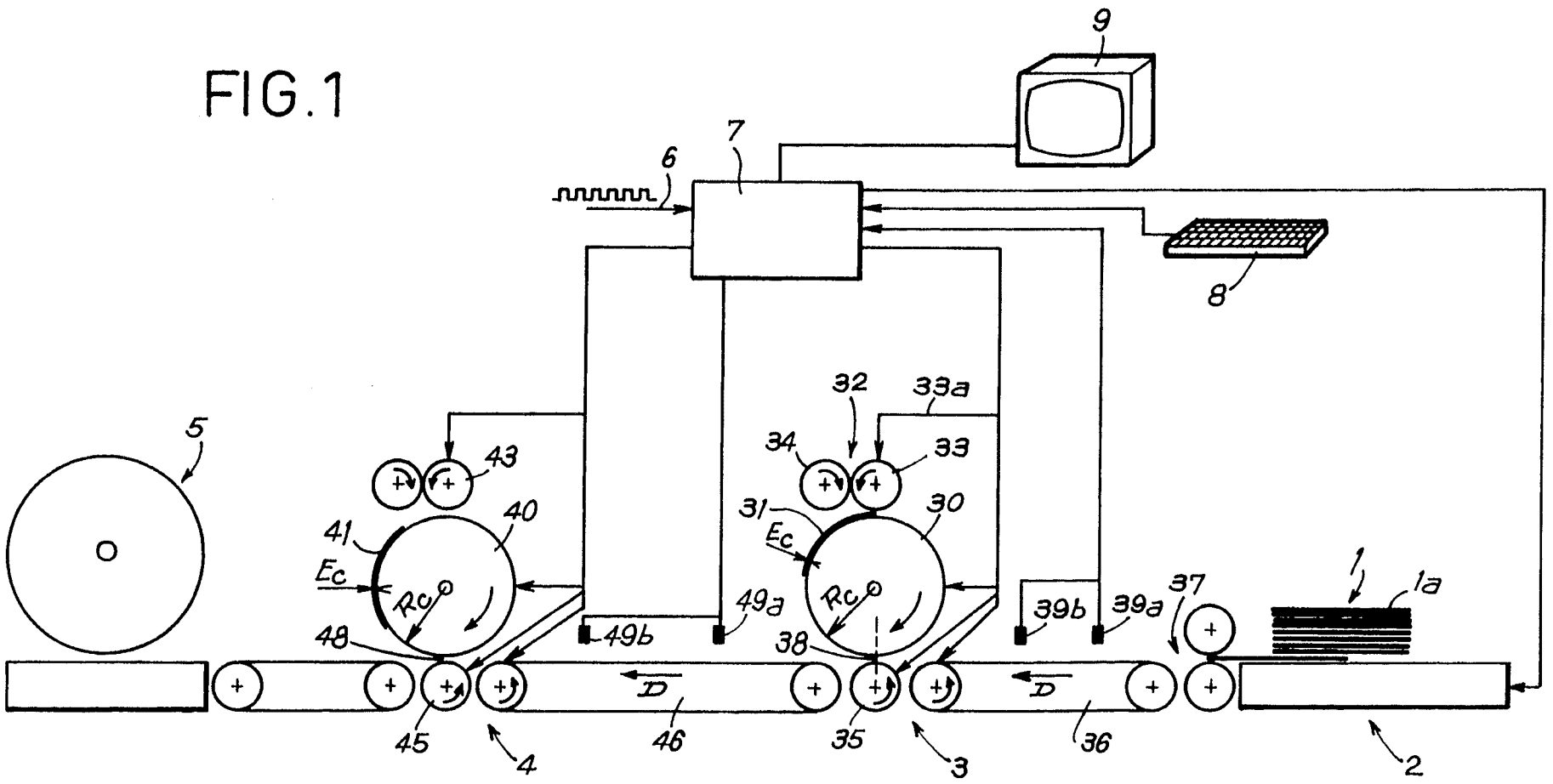
FIG. 1 is a diagram of a print line of the invention that comprises two sheet-fed flexographic print installations.

The flexographic print line shown diagrammatically in FIG. 1 by way of non-limiting example enables two-pass printing to be performed on each sheet of a batch 1 of sheets 1*a*, in particular corrugated card sheets, that are of identical length. This particular print line includes a feeder 2 that enables each sheet 1*a* to be inserted successively at predetermined time intervals into the inlet of a first installation 3 of the invention. Each sheet 1*a* printed on by the installation 3 is then inserted into a second installation 4 of the invention which is situated directly downstream from the first installation, and after being printed on for a second time, it is transferred to a cutter 5.

The first installation 3 comprises:

a plate-carrier cylinder 30 of radius $R_c$ with a plate 31 of thickness $E_c$ mounted at the periphery thereof;

an inking system 32;

a backing cylinder 35; and a transfer system 36 of the cog belt type.

The inking system 32 consists in a screened cylinder 33 and a rubber cylinder 34 which is tangential thereto. The surface of the screened cylinder includes a multitude of recesses enabling it to receive ink which is applied to the rubber cylinder by means of a pump (not shown). During rotation, the screened cylinder 33 serves to ink the plate 31 which represents the pattern to be printed.

The transfer system 36 enables each sheet to be moved in the direction of arrow D from the inlet 37 of the transfer system 36 to the pinch line 38 between the backing cylinder 35 and the plate-carrier cylinder 30.

The plate-carrier cylinder 30, the screened cylinder 33, the transfer system 36, and the backing cylinder 35 are each rotated by an individual motor under electronic control, each motor being of the brushless type. In accordance with the invention, all of the motors are connected to an electronic circuit 7 that controls the positions thereof. The directions of rotation of the various elements constituting the first installation 3 are represented by arrows in FIG. 1.

The first installation 3 also includes two sensors 39*a* and 39*b* of the photoelectric cell type that serve respectively to detect the passage of the trailing edge and of the leading edge of a sheet 1*a* on the transfer system 36, which sensors are connected to the electronic circuit 7.

The second installation 4 is similar to the first installation 3 as described above, and it is connected in the same manner to the electronic circuit 7. It is therefore not described again. However, it should be observed that the plates 31 and 41 may be of different lengths. The same applies to the transfer systems 36 and 46. Nevertheless, it is necessary for the distance between the two pinch lines 38 and 48 of the two installations 3 and 4, and also for the distance between the pinch line 38 and the outlet of the feeder 2 to be not less than the maximum length of the sheets to be printed.

The electronic circuit 7 has an input on which it receives a purely electronic reference signal 6 for synchronizing the brushless motors of the two installations. It also includes a display screen 9 and input means such as a keyboard 8, for inputting the operating parameters of the two installations 3 and 4, and in particular the thickness $E_c$ of the plates 31 and 41 and the print rate of the line.

The print line operates as follows. The printer uses the keyboard 8 to input the thickness $E_c$ of the plates 31 and 41 which have been installed on the plate-carrier cylinders 30 and 40, and also the print rate of the line, i.e. the time interval T between printing on two successive sheets. The electronic circuit 7 automatically controls rotation of the two plate-carrier cylinders 30 and 40 synchronously with the reference signal 6 in such a manner as to cause them to rotate through 360° at a constant speed of rotation $\Omega_c$ during time interval T. This speed of rotation $\Omega_c$ is thus a function solely of the print rate selected by the printer, and it is not modified when a plate is changed.

The feeder 2 is connected to the electronic circuit 7 which controls it in such a manner as to enable a sheet 1*a* to be inserted synchronously with reference signal 6 at each time interval T, i.e. on each rotation through 360° of the plate-carrier cylinders 30 and 40.

With sheet-fed printing, it is very important that the pattern printed on each sheet should always be at the same distance either from the leading edge or else from the trailing edge of said sheet. This distance may be referred to as the "setting" distance. To adjust the setting distance in each installation 3 and 4 prior to beginning printing, it is necessary to position each plate-carrier cylinder 30 and 40 accurately. This positioning is under the control of the electronic circuit 7 as a function of a setting parameter which is input by the printer via the keyboard 8, and which may be displayed on the screen 9.

The electronic circuit 7 is programmed automatically to control the positions of the brushless motors that drive the backing cylinder 35 and the screened cylinder 33 respectively in such a manner as to ensure that the peripheral linear speeds of said cylinders are both equal to the linear speed of the plate 31. This speed is a function solely of the speed of rotation $\Omega_c$, of the radius $R_c$, of the plate-carrier cylinder 30, and of the thickness $E_c$ of the plate 31. This condition of equal speeds is important for the screened cylinder particularly when it is in contact with the plate 31 so as to ensure that inking is performed uniformly. Similarly, this speed equality condition is necessary for the backing cylinder 35 whenever the plate 31 is in contact with a sheet so as to ensure that contact takes place during printing without any slip.

The rotation of the plate-carrier cylinder 30 may be subdivided into two successive time intervals $T_1$ and $T_2$ during which, respectively, the plate 31 is printing, i.e. is engaged in the pinch line 38, and the plate is not printing. The electronic control circuit 7 is programmed to control the position of the brushless motor driving the transfer system 36 in such a manner that the linear speed of the transfer system is equal to the linear speed of the plate 31 during time interval $T_1$. During time interval $T_2$, the control circuit 7 is programmed to perform position corrections and consequently to control the speed of the brushless motor driving the transfer system 36 in a manner described below.

Depending on whether printing is to be in register relative to the leading edge or the trailing edge of a sheet 1*a*, the printer uses the keyboard 8 to select one or other registration sensor 39*b* or 39*a*. In theory, the leading or trailing edge of each sheet inserted by the feeder 2 into the inlet of the transfer system 36 moves past the sensor 39*b* or 39*a* when the plate-carrier cylinder 30 is in a predetermined position that depends on the initial setting of said cylinder. In practice, it can happen that the sheets 1*a* are subject to a small amount of slip relative to the transfer system, thereby offsetting the positions thereof relative to the ideal positions they ought theoretically to occupy. In addition, the sheets 1*a* may be slightly different in length, and this is not taken into account by the feeder when synchronizing insertion of the sheets relative to the reference signal 6. To mitigate these drawbacks, each time the registration sensor 39*b* or 39*a* that has been selected detects the passage of the leading edge or of the trailing edge of a sheet, the electronic circuit 7 compares the position of the plate-carrier cylinder 30 relative to the ideal position it ought to be occupying, and it controls the motor driving the transfer system as a function of the observed difference and in such a manner as to reposition the sheet 1*a* accurately relative to rotation of the plate 31. This correction is performed solely during time interval $T_2$.

The motors in the installation 4 are controlled by the electronic circuit 7 in a manner similar to the motors in the installation 3 as described above, and this is not described again. Given that the plate-carrier cylinders 30 and 40 have the same radius $R_c$ and the same speed of rotation $\Omega_c$, and given that the plates 31 and 41 have the same thickness $E_c$, the linear speed of the plate 41 is equal to the linear speed of the plate 31. Consequently, the screened cylinder 43 has the same peripheral speed as the screened cylinder 33. Similarly, while the plate 41 is printing, the transfer system 46 will have the same linear speed as has the transfer system 31 during time period $T_1$.

In order to ensure that each sheet inserted by the feeder 2 takes up the proper position on the transfer system 36, it is necessary for the speed imparted thereto by the feeder at the moment of insertion to be substantially equal to the linear speed of the transfer system.

Each installation 3 and 4 also advantageously includes apparatus for adjusting the position of the screened cylinder 33, 43 relative to the plate carrier cylinders 30, 40, which apparatus is fitted with an individual motor of the brushless type under the control of the electronic circuit 7. Such apparatus is well known, and has already been described in document FR 2 553 032, in particular. In this case, the electronic circuit 7 is programmed to bring the screened cylinder 33 or 43 very accurately to its working position so as to ensure that the surfaces of the plate-carrier cylinder 30 or 40 and of the screened cylinder 33 or 43 are spaced apart by the thickness $E_c$. Similar adjustment apparatus may be used for positioning the backing cylinder 35 or 45 relative to the plate-carrier cylinder 30 or 40, as a function of plate thickness $E_c$ and as a function of thickness of the sheets 1*a*.

The electronic circuit 7 is preferably also programmed to control displacement of the screened cylinder 33 or 43 from its working position to a retracted position, and vice versa, synchronously with the reference signal and as a function of the state of the selected registration sensor. This principle of retraction as applied to the screened cylinder 33 of the first installation 3 is shown in FIGS. 2A and 2B.

Figure 2A:
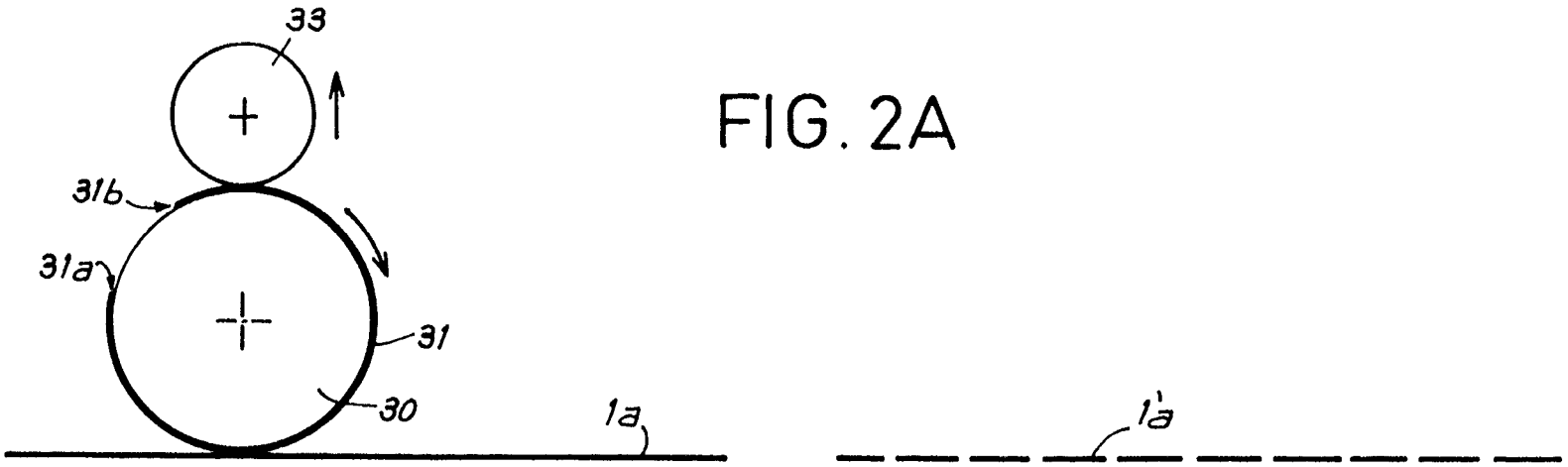
FIGS. 2A and 2B show how the screened cylinder is retracted in an installation of the invention.
Figure 2B:
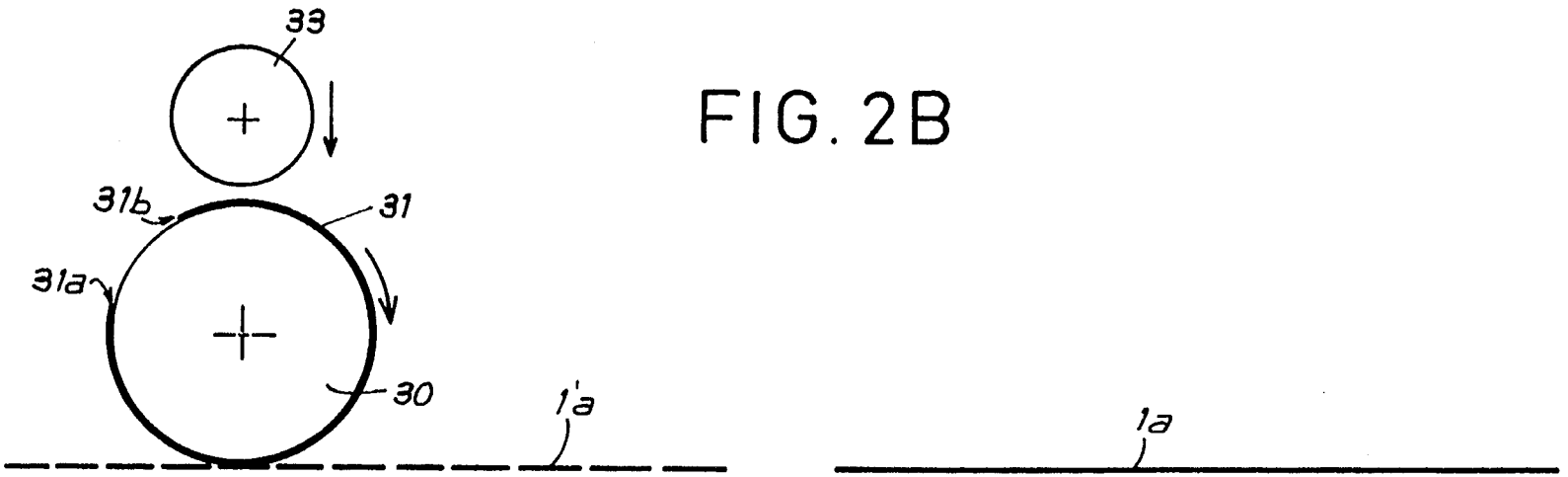

In FIG. 2A, the plate 31 of the plate-carrier cylinder 30 is printing on a sheet 1*a*, while the screened cylinder 33 is in its working position, bearing tangentially against the plate 31. Dashed lines are used to indicate the position that ought to be occupied by the following sheet 1'*a*, which sheet is absent. When the trailing edge 31*b* of the plate 31 reaches the screened cylinder 33 and when the selected registration sensor 39*a* or 39*b* has failed to detect a following sheet, the electronic circuit 7 retracts the screened cylinder 33 so as to cause it to take up the position shown in FIG. 2B. With reference to FIG. 2B, given that the sheet 1*a* is absent, the screened cylinder 33 is not in contact with the plate 31. When the trailing edge 31*b* of the plate 31 comes level with the screened cylinder 33, the electronic circuit 7 causes the cylinder 33 to be lowered into its working position since a new sheet 1*a* has been detected by the selected registration sensor 39*a* or 39*b*. The screened cylinder 33 must be put into position in this way before the leading edge 31*a* of the plate 31 comes level with the screened cylinder 33. By retracting the screened cylinder in the event of one or more sheets being absent, it is possible to avoid useless inking of the plate which would then give rise to an accumulation of ink that could spoil printing in that successive patterns would be printed with different densities.

The print line of the invention has the advantage of being able to operate with plates of any type, and in particular with plates of various thicknesses, without there being any need to make any modification to the line. In addition, changing the plates of the print line does not modify the speed of rotation of the plate-carrier cylinders, and consequently does not require any modification in printing rate.

The invention is not limited to the particular print line described above, but covers any variants thereof. The backing cylinders may be replaced by stationary beams, or they may be rotated by the motor of the corresponding transfer system. It is also possible for the plate-carrier cylinder of one of the installations to be fitted with an encoder for delivering a signal to the electronic circuit 7, which signal is a function of the angular position of said cylinder, and is used as the reference signal 6. In this case, the motor of the plate-carrier cylinder may be a DC motor fitted with means for varying its speed, and the speed of rotation of said motor is initially adjusted as a function of the print rate of the line.

We claim:

1. A sheet feed print installation comprising:

a plate-carrier cylinder having a plate of thickness $E_c$ fixed to the periphery thereof;

a backing system, optionally constituted by a backing cylinder;

a screened cylinder; and a transfer system having an inlet into which the sheets are inserted one by one and which bring each sheet in succession to the pinch line between the plate-carrier cylinder and the backing cylinder; the installation further comprising:

a) three or four motors which are mechanically independent, the first rotating the plate-carrier cylinder, the second rotating the screened cylinder, the third rotating the transfer system, and optionally the fourth rotating the backing cylinder; and b) an electronic circuit connected to the second, third, and optionally fourth motors, that receives an input reference signal and that includes means for inputting operating parameters, including at least the thickness $E_c$ of the plates and the print rate;

wherein the first motor rotates the plate-carrier cylinder synchronously with the reference signal in such a manner that the plate-carrier cylinder rotates through 360° at constant speed during the time interval that corresponds to the print rate; and wherein the electronic circuit automatically controls rotation of the second, third, and optionally fourth motors on the basis of the reference signal and as a function of the thickness $E_c$ in such a manner firstly that the peripheral linear speed of the screened cylinder is equal to the linear speed of the plate on the plate-carrier cylinder, and secondly that the linear speed of the transfer system and optionally the peripheral linear speed of the backing cylinder are equal to the linear speed of the plate on the plate-carrier cylinder at least during the time interval $T_1$ during which the plate is printing.

2. An installation according to claim 1, wherein the first motor rotates the plate-carrier cylinder at a predefined constant speed of rotation and the plate-carrier cylinder is fitted with an encoder that delivers the reference signal to the electronic circuit, which reference signal is a function of the angular position of the plate-carrier cylinder.

3. An installation according to claim 1, wherein the first motor is connected to the electronic circuit which receives an input reference signal and which is suitable for controlling the rotation of the first motor synchronously with said signal.

4. An installation according to claim 3, wherein prior to beginning sheet by sheet printing, the electronic circuit is suitable for controlling rotation of the first motor in such a manner as to bring the plate-carrier cylinder into an initial angular position that depends on a predefined setting parameter.

5. An installation according to claim 1, further comprising in the transfer system at least one registration sensor connected to the electronic circuit and suitable for sensing the passage of an edge of a sheet, and wherein said electronic circuit is also suitable, synchronously with the reference signal, for controlling the rotation of the third motor firstly during each time interval $T_1$ during which the plate is printing so that the linear speed of the transfer system is equal to the linear speed of the plate, and secondly during each time interval $T_2$ during which the plate is not printing so that the edge whose passage is detected at a determined distance from the pinch line reaches said pinch line when the plate-carrier cylinder is in a determined position.

6. An installation according to claim 5, comprising two registration sensors disposed in the transfer system, one for detecting the leading edge, and the other for detecting the trailing edge of each sheet, and means connected to the electronic circuit for selecting one or other of the sensors.

7. An installation according to claim 1, wherein it is fitted with apparatus for adjusting the axial distance of the screened cylinder relative to the plate-carrier cylinder, said apparatus being provided with a fifth individual motor connected to the electronic circuit, which circuit is suitable for controlling said fifth individual motor so as to bring the screened cylinder to a working position that depends on the thickness $E_c$ of the plate, and in which it bears against the surface of the plate.

8. An installation according to claim 5 or 7, wherein the electronic circuit is suitable for controlling the rotation of the fifth individual motor so as to cause the screened cylinder to move from its working position to a retracted position and vice versa each time the edge of a following sheet is not detected or is detected again, respectively, and to do so synchronously with the reference signal in such a manner as to ensure that said displacement takes place while the screened cylinder overlies the zone of the plate-carrier that is not carrying a plate.

9. An installation according to claim 1, wherein it is fitted with apparatus for adjusting the distance between the backing system and the plate-carrier cylinder, said apparatus being provided with a sixth individual motor connected to the electronic circuit which circuit is suitable for controlling rotation thereof in such a manner as to bring the backing system into a working position that depends on plate thickness $E_c$ and on the thickness of the sheets that are to be printed.

10. A print line for multiple sheet-fed printing, comprising a plurality of installations according to claim 1, in which the plate-carrier cylinders are identical and are fitted with plates having the same thickness $E_c$, and wherein all of the motors in each installation are connected to a single electronic circuit.

11. A print line for multiple sheet-fed printing, comprising a plurality of installations according to claim 2, in which the plate-carrier cylinders are identical and are fitted with plates having the same thickness $E_c$, wherein all of the motors in each installation are connected to a single electronic circuit, and wherein the referenced signal received by the electronic circuit corresponds to the signal delivered by the encoder of the plate-carrier cylinder of said installation.

* * * * *